US005370571A

United States Patent [19]

Bosch

[11] Patent Number: 5,370,571

[45] Date of Patent: Dec. 6, 1994

[54] TOY PROJECTILE LAUNCHING DEVICES

[75] Inventor: Warren E. Bosch, Burlington, N.J.

[73] Assignee: Tyco Investment Corp., Wilmington, Del.

[21] Appl. No.: 4,377

[22] Filed: Jan. 14, 1993

[51] Int. Cl.[5] ..... A63H 29/24; F41B 15/00

[52] U.S. Cl. ..... 446/429; 446/268; 124/79; 124/35.1; 124/29; 124/36; 273/128 R; 273/129 W; 273/129 V; 273/428

[58] Field of Search ..... 446/429, 430, 435, 308, 446/309, 247, 266, 268, 450, 473, 486; 273/128 R, 128 A, 129 T, 129 W, 129 V, 428, 87.2, 87 D, 87 R, 145 B, 129 P; 124/1, 79, 54, 35.1, 26, 5, 6, 37, 29

[56] References Cited

U.S. PATENT DOCUMENTS

| | | | |
|---|---|---|---|
| 99,023 | 1/1870 | Splitdorf . | |
| 827,413 | 7/1906 | Bowers | 124/36 X |
| 1,062,129 | 5/1913 | Sweeney . | |
| 1,063,803 | 6/1913 | Jones . | |
| 1,089,229 | 3/1914 | Klein . | |
| 1,504,819 | 8/1924 | Hanwell . | |
| 1,649,045 | 11/1926 | Tickel . | |
| 1,721,704 | 7/1929 | Madaschi . | |
| 1,841,098 | 1/1932 | Esser . | |
| 1,883,029 | 10/1932 | Smith . | |
| 2,274,009 | 2/1942 | Stephens . | |
| 2,279,857 | 4/1942 | Bodnar | 124/1 X |
| 2,303,652 | 12/1942 | McGaugh . | |
| 2,600,116 | 6/1952 | Kopf . | |
| 2,680,934 | 6/1954 | Gowland . | |
| 2,858,644 | 11/1958 | Derham . | |
| 3,084,680 | 4/1963 | Goldfarb et al. | 124/36 X |
| 3,108,395 | 10/1963 | Goldfarb . | |
| 3,403,669 | 10/1968 | Crosman . | |
| 3,462,153 | 8/1969 | Giraud et al. . | |
| 3,466,792 | 9/1969 | Goldfarb . | |
| 3,469,846 | 9/1969 | Lippert | 273/129 W X |
| 3,481,605 | 12/1969 | Giraurd et al. | 446/309 X |
| 3,572,715 | 3/1971 | Ramirez . | |
| 3,596,400 | 8/1971 | Cheng . | |
| 3,691,675 | 9/1972 | Rodgers . | |
| 3,709,495 | 1/1973 | Krombein . | |
| 3,715,121 | 2/1973 | Renn et al. . | |
| 3,739,764 | 6/1973 | Allport . | |
| 3,892,405 | 7/1975 | Trevino | 273/87.2 |
| 4,246,719 | 1/1981 | Kulesza et al. . | |
| 4,402,507 | 9/1983 | Hudson | 124/36 X |
| 4,504,242 | 3/1985 | Crain et al. | 446/435 X |
| 4,564,197 | 1/1986 | Lambert et al. | 446/430 X |
| 4,575,348 | 3/1986 | Wiggs et al. . | |
| 4,661,080 | 4/1987 | Goldstein et al. | 446/429 X |
| 4,689,034 | 8/1987 | Dubois et al. . | |
| 4,690,658 | 9/1987 | Crosson et al. | 124/79 X |
| 5,069,451 | 12/1991 | Martens et al. | 124/79 X |

FOREIGN PATENT DOCUMENTS

| | | | |
|---|---|---|---|
| 615302 | 7/1935 | Germany | 273/129 V |

*Primary Examiner*—Danton D. DeMille
*Attorney, Agent, or Firm*—Panitch Schwarze Jacobs & Nadel

[57] ABSTRACT

Projectile launching toys include a surface suitably configured to support and guide a projectile, a lever pivotally mounted so as to traverse a portion of the surface in the direction the projectile is being guided, a manual actuator coupled to the lever to manually move the lever from an initial position to a second, pivoted position to launch the projectile and a return member coupled with the lever to automatically return the lever to its original position after being manually moved and released.

9 Claims, 9 Drawing Sheets

TOY PROJECTILE LAUNCHING DEVICES

FIELD OF THE INVENTION

The present invention relates to toys and, in particular, to devices for launching toy projectiles.

BACKGROUND OF THE INVENTION

Toy projectile launching devices are well known. Toy mechanical projectile launching mechanisms tend to be actuated by one or more springs or other, similarly resilient, energy storing member(s). Typically, at least one spring is provided which is compressed, extended or twisted by the user to store energy. At the end of the energy storing step the spring is suddenly released, thereby permitting the spring to return to its original condition and, at the same time, propel a projectile.

One drawback of such toy projectile launching mechanisms with energy storing devices is that often they are configured in a way which permits them to be accidentally fired or may become sufficiently worn or broken to fire on their own accord. These toy mechanisms are viewed as being so potentially hazardous that they are covered by their own safety requirement. See ASTM Standard F963 (section 4.20), incorporated by reference herein.

Toy manufacturers and designers are constantly looking for or developing novel mechanisms to provide unusual play action in toys to entertain their users. Toys which accomplish known results but which employ unusual actions and therefore provide a new challenge or a fresh appearance to the user, are extremely valuable in the toy industry. It is believed that toy projectile launching devices without energy storing components and with unusual actions could be even more valuable.

SUMMARY OF THE INVENTION

In general, the invention is a toy projectile launching device comprising: a surface configured to support and guide a toy projectile along a path from an initial position of the projectile on the surface to an exit from the surface; a lever having opposing longitudinal first and second ends and a pivot between the first and second ends, the lever being supported at the pivot such that the first end of the lever traverses the surface along the path in a direction from the initial position towards the exit from the surface when the lever is rotated on the pivot between opposing, extreme first and second positions; an actuator coupled with the second end of the lever, at least a portion of the actuator being configured and exposed sufficiently to be manually grasped and moved to rotate the lever from the first position to the second position; and a return member positioned so as to automatically return the lever from the second position to the first position after manual movement of the lever by the actuator.

In a more particular aspect, the invention is a toy cannon comprising: a launch tube with a hollow interior and an open end; a lever extending through a side of the tube, the lever including a first portion with first longitudinal end at least partially spanning the hollow interior in a generally radial direction and a second portion with second longitudinal end projecting outside the tube; an actuator coupled with the second end of the lever, at least a portion of the actuator being configured to be manually grasped and moved to move the first end of the lever from an initial position towards the open end of the tube; a pivot rotatably supporting the lever with respect to the tube, the first end of the lever within the hollow interior of the tube being spaced farther from the pivot than is the coupling of the actuator with the second end of the lever; and a return member coupled with the lever so as to automatically return the lever to the initial position after manual movement of the lever with the actuator.

In yet another particular aspect, the invention is a toy vehicle launcher comprising: a base with a surface generally configured to support and guide a wheeled toy vehicle along a path on the base; a lever having opposing, longitudinal first and second ends, the lever being supported on a pivot such that the first end of the lever traverses the surface along the path when the lever is rotated on the pivot between opposing, extreme first and second positions; a trigger moveably secured with the base and coupled with the second end of the lever, the first end of the lever is sufficiently long to contact a wheeled toy vehicle on the surface and is spaced farther from the pivot than is the coupling of the trigger with the second end of the lever, at least a portion of the trigger being configured and exposed sufficiently to be manually grasped and moved to rotate the lever from the first position to the second position; and a return member coupled with the lever so as to automatically return the lever to the extreme first position when the trigger is manually released after being manually moved toward the second extreme position of the lever.

BRIEF DESCRIPTION OF THE DRAWINGS

The foregoing summary, as well as the following detailed description of the presently preferred embodiments of the invention, will be better understood when read in conjunction with the appended drawings. It should be understood, however, that this invention is not limited to the precise arrangements illustrated. In the drawings.

DETAILED DESCRIPTION OF PREFERRED EMBODIMENTS

Figure 1:
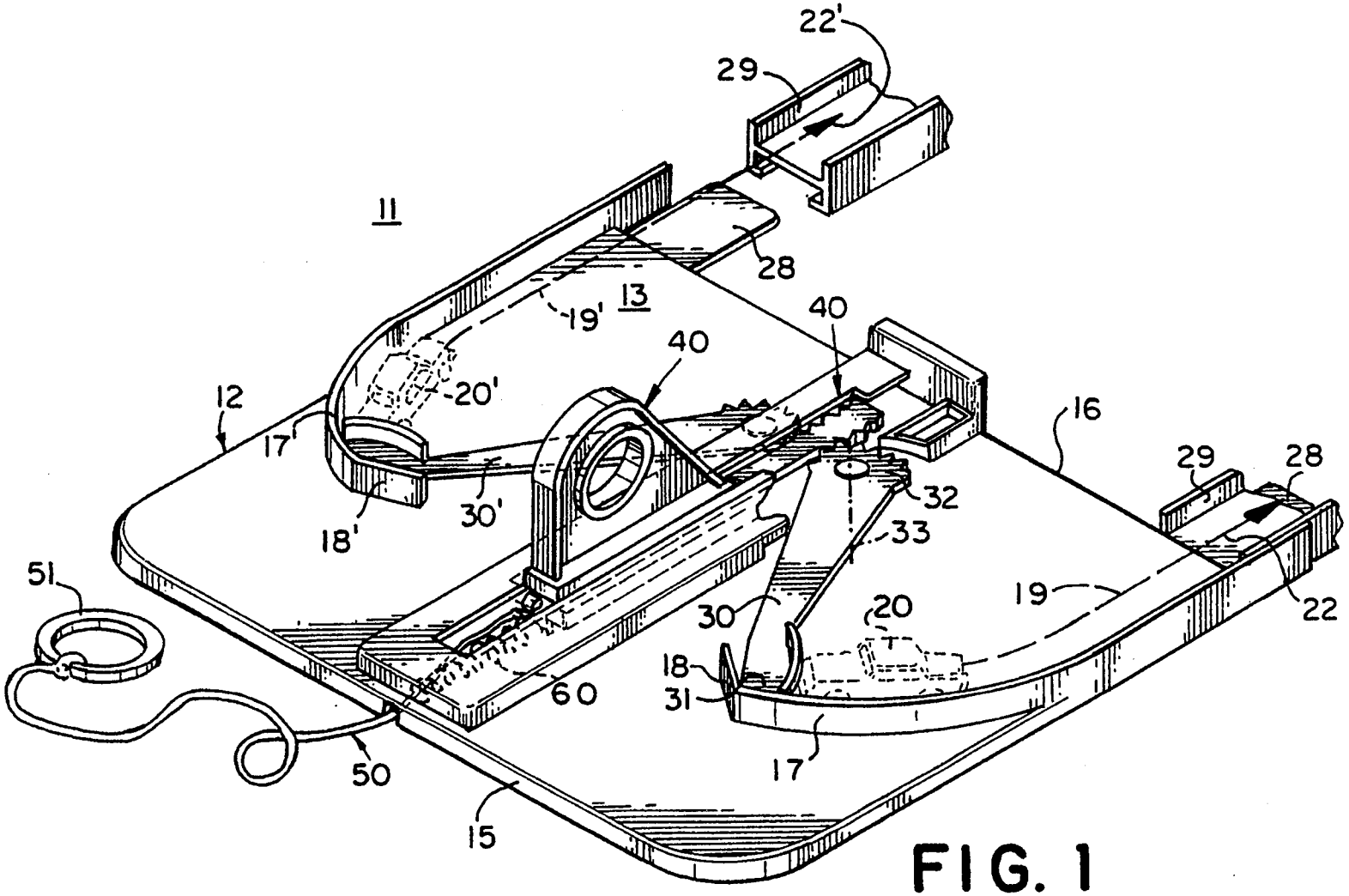
FIG. 1 is a perspective drawing of a first toy projectile launching toy device of the present invention.
Figure 2:
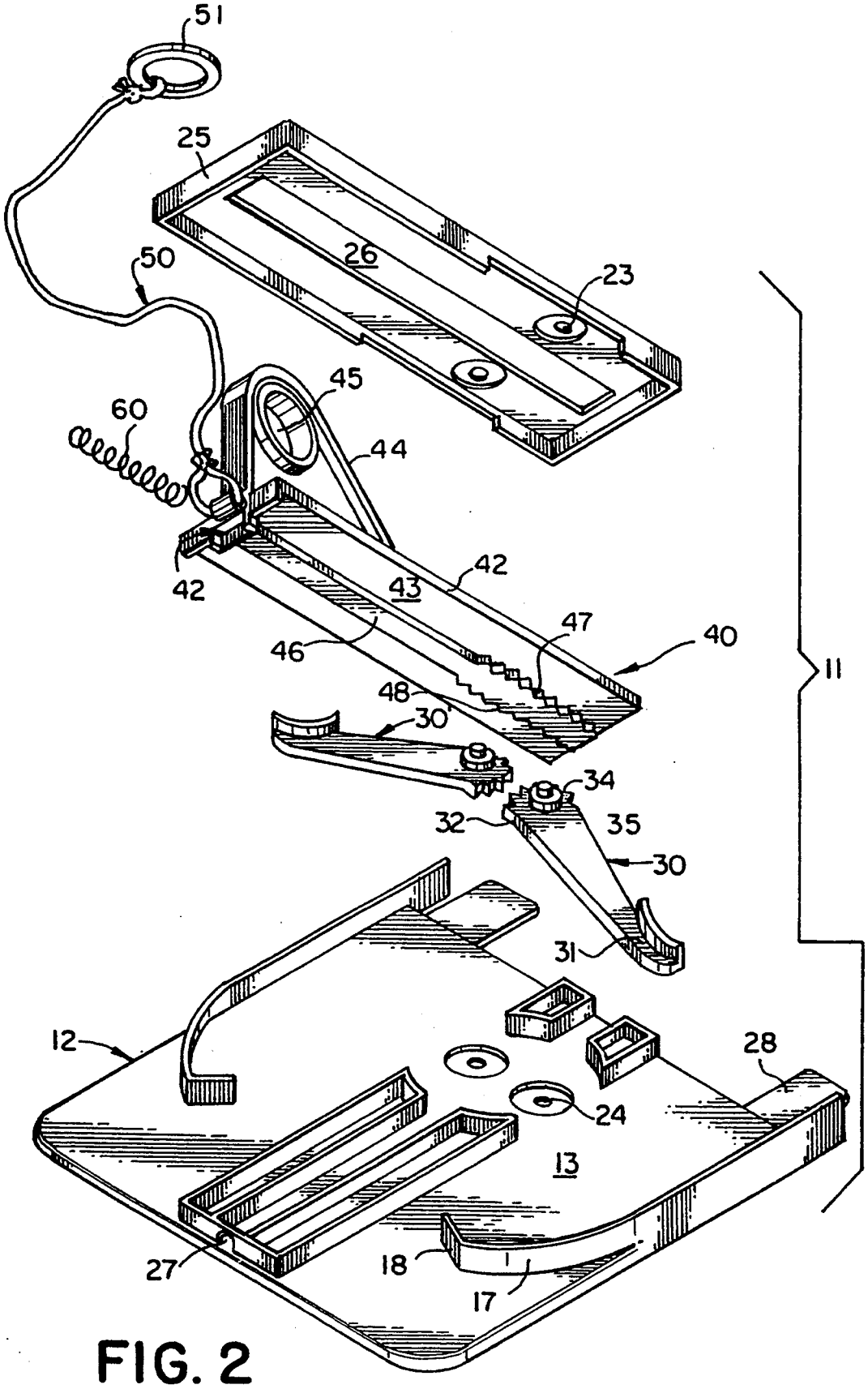
FIG. 2 is an exploded view of the device of FIG. 1.

Certain terminology is used in the following description for convenience only and is not limiting. The terms "right," "left," "lower" and "upper" designate directions in the drawings to which reference is made. The words "inward" and "outward" refer to directions towards or away from, respectively, the geometric center of the device or designated parts thereof. The terminology includes the words mentioned specifically above, derivatives thereof and words of similar import.

Referring to the drawings, wherein like numerals indicate identical elements throughout there is shown in FIGS. 1–4 a first, rack and pinion embodiment toy projectile launching device of the present invention, indicated generally at 11, in the form of a wheeled toy vehicle launcher. Launcher 11 includes a base indicated generally at 12, a first lever 30, a second lever 30', which is a mirror of the first lever 30, an actuator indicated generally at 40, which is coupled with each lever 30, 30', and a return member 60. The base 12 has an exposed upper side 13 from which a pair of curved, mirror image vertical walls 17, 17' project. The base 12 has opposing first and second ends 15 and 16. Preferably extending outwardly from the second end 16 of the base 12, at either lateral side, are identical mating tabs 28, each of which releasably receives a suitably configured mating section of track 29. Together, the walls 17, 17' and upper side 13 define mirror surfaces, each configured to support and guide a toy projectile preferably in the form of a wheeled toy vehicle indicated in phantom at 20 and 20', respectively, along a path, indicated by broken lines 19 and 19', respectively, from a first end of each path or initial position of the projectiles, i.e. where the vehicles are shown in FIG. 1, until the vehicles exit those respective surfaces at the second end 16 of the base 13 heading along track(s) 29 towards a second, opposing end of each path 19, 19', which is indicated diagrammatically by arrows 22 and 22', respectively.

Since the levers 30 and 30' are mirror images, and symmetrically positioned, supported and operated, only the first lever 30 will be described. Lever 30 has opposing longitudinal first and second ends 31 and 32, respectively, and a pivot 33, which is indicated by a vertical broken line in FIG. 1 and which is located between the ends 31 and 32. The levers 30 and 30' rotate on their respective pivots between opposing extreme first and second positions illustrated in FIGS. 1 and 4, respectively. The lever 30 is supported at the pivot 33 such that the first end 31 of the lever 30 moves in a horizontal plane and horizontally traverses or sweeps the generally horizontal upper side 13, between pivot 33 and the vertical wall 17 along path 19 in a direction from the first end of the path 19 and initial position of the projectile/vehicle 20 towards the second end 16 of the base 13 where the projectile/vehicle 20 exits the device 11, as the lever 30 is rotated on pivot 33 between the opposing, extreme first and second positions.

The second end 32 of the lever 30 is located closer to the pivot 33 than is the first end 31 of the lever so as to maximize the linear acceleration of the lever 30 at the first end 31. In this embodiment, the second end 32 of the lever is preferably generally semi-circular and provided with a plurality of gear teeth 34 extending at least partially around the lever 30 at the extreme second end 32 of the lever 30. Pivot 33 is preferably physically defined by upwardly and downwardly extending, generally coaxially aligned pins 35 and 36, respectively, which are received in journals 23 and 24, respectively, provided in the upper side 13 and in a cover 25, respectively, of the device 11.

Cover 25 preferably is mounted on the upper side 13 and includes a longitudinal center slot 26 which receives and movably couples, preferably slidably secures a trigger 42 of the actuator 40 to the base 12. Trigger 42 includes a generally parallelepiped slide portion 43, the sides of which underlie the cover 25 on either side of the slot 26. The lower side of trigger 42 is preferably provided with a double-sided rack 46 having two opposing sets of teeth 47, 48. Levers 30 and 30' are coupled with trigger 42 by engagement of teeth 47 on a first side of the rack 46 with gear teeth 34 on the second end 32 of the first lever 30 and engagement of substantially identical set of teeth 48, projecting in an opposite direction from the rack 46, with teeth 34' of the second lever 30'.

At least a portion of each of the actuators of the present invention is configured and exposed sufficiently to be manually grasped and moved to rotate the lever or levers from the initial, rest or "first" position to the advanced, forwardmost or "second" position of the lever(s). Actuator 40 is actually provided with two such portions.

First, a finger grip 44 projects upwardly from the upper side of slide portion 43 through the slot 26. Finger grip 44 is configured by the provision of an opening 45 which is exposed sufficiently to be gripped by a finger of the user.

Second, actuator 40 preferably includes a lanyard 50, having a grip in the form of a finger ring 51 at one end. The remaining end passes through a small opening 27 in the cover 25 at the first end 15 of the base and is secured with the trigger 42. The lanyard 50 provides an alternate means to the finger grip 44 for moving the trigger 42 from the exit end 16 of the base towards the first end 15. Lanyard 50 preferably is passed through an opening in base 12 so as to assure that it will move the trigger 42 efficiently and only in a rearward direction and the levers 30, 30' only in the direction from their first position (FIG. 1) to their second position (FIG. 4).

One of ordinary skill will appreciate that only one of the two pairs of elements 44/45 and 50/51 needs to be provided for manual movement of the actuator and that one or the other of the element pairs 44/45 or 50/51 may be eliminated and, further, that other, comparable features may be substituted for either or both pairs of elements to achieve the same end, namely the manual movement of trigger 42.

Figure 4:
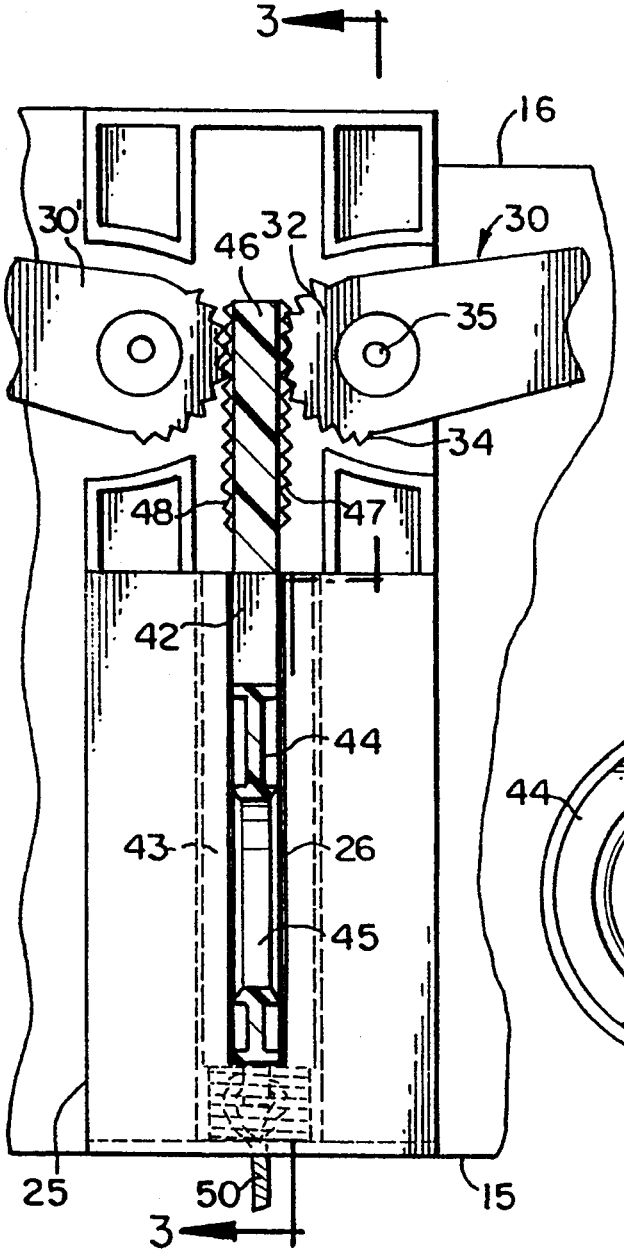
FIG. 4 is a plan sectioned view of the center of the device of FIG. 1 taken along lines 4—4 in FIG. 3.
Figure 3:
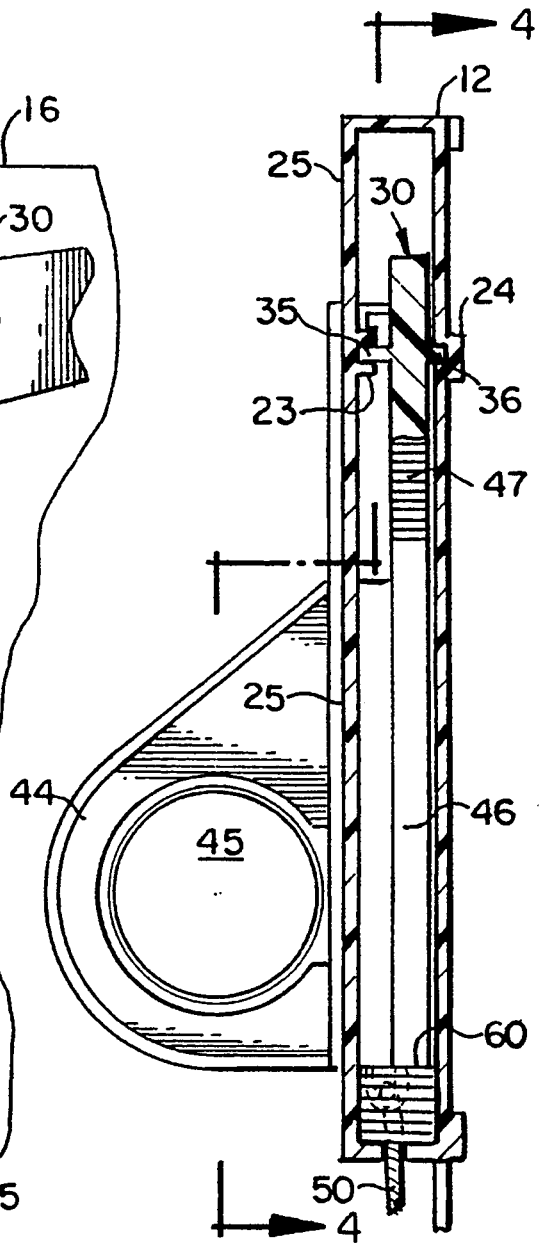
FIG. 3 is a side sectioned view of the center of the device of FIG. 1 taken along the lines 3—3 in FIG. 4.

Return member 60 is preferably provided and positioned so as to automatically return levers 30 and 30' from their second, forwardmost position seen in FIG. 4, after manual movement of the levers 30, 30' to those positions by means of the actuator 40, to their initial or first positions shown in FIG. 1. Member 60 or its equivalent should be capable of storing energy when levers 30, 30' are manually moved from their initial position. If mechanical, the return member typically will be at least resiliently flexible to store energy during movement of the lever(s) to return the lever(s) to original position(s). The return member of the first embodiment is preferably a coil spring (also 60) located under the cover 25 around the lanyard 50 between facing ends of the trigger 42 and the cover 25. Member 50 is coupled to levers 30, 30' through trigger 42 and its teeth 47, 48.

Operation of the device 11 is as follows. The device 11 is biased to the initial configuration shown in FIG. 1 by return member 60 with levers 30, 30' in their first extreme pivoted position. The levers 30 and 30' may be pivoted back to contact turned in portions 18, 18' of vertical walls 17 and 17', respectively, which can be provided to act as stops. The trigger 42 of the actuator 40 is located in a "forwardmost" position. A wheeled toy vehicle 20 or other toy projectile is placed against the first end of a lever, for example lever 30, preferably abutting vertical wall 17 and supported on upper side 13. The vehicle 20 or other projectile is launched either by gripping the base 13 with one hand and the trigger 42 through the opening 45 or the lanyard 50, for example, through its finger ring 51, with another hand and sharply sliding the trigger 42/lanyard 50 rearwardly, towards the user and the first end 15 of the base 12. The teeth 47 of rack 46, engaging gear teeth 34 of lever 30, rotate the second end 32 of the lever 30 counterclockwise about the pivot 33 and swing the lever 30 from its first position shown in FIG. 1 to its second, extreme pivot position depicted in FIG. 4. Lever 30' is simultaneously rotated in an identical fashion in a clockwise direction through rack teeth 48. Due to the significant difference in length between the first end 31 and the pivot 33 and between the second end 32 and pivot 33, the first end 31 of the lever 30 will be rapidly, linearly accelerated from the first or initial position shown in FIG. 1 to its second, opposing, extreme position shown in FIG. 4 by sharply moving the actuator 40 rearwardly towards the first end 15 of the base. The vehicle 20, which is supported on the upper side 13 of the base 12, is further guided by the inner facing side of vertical wall 17 until the vehicle exits the base along the track 29 on its path 19. The first end of path 19, which is defined by the curved portion of wall 17, is preferably radiused with respect to the pivot 33. Upon release of the finger grip 44 and/or lanyard 50, the return member 60 forces the trigger 42 forward, and automatically returns the device 11 back to its original configuration shown at FIG. 1.

Figure 5:
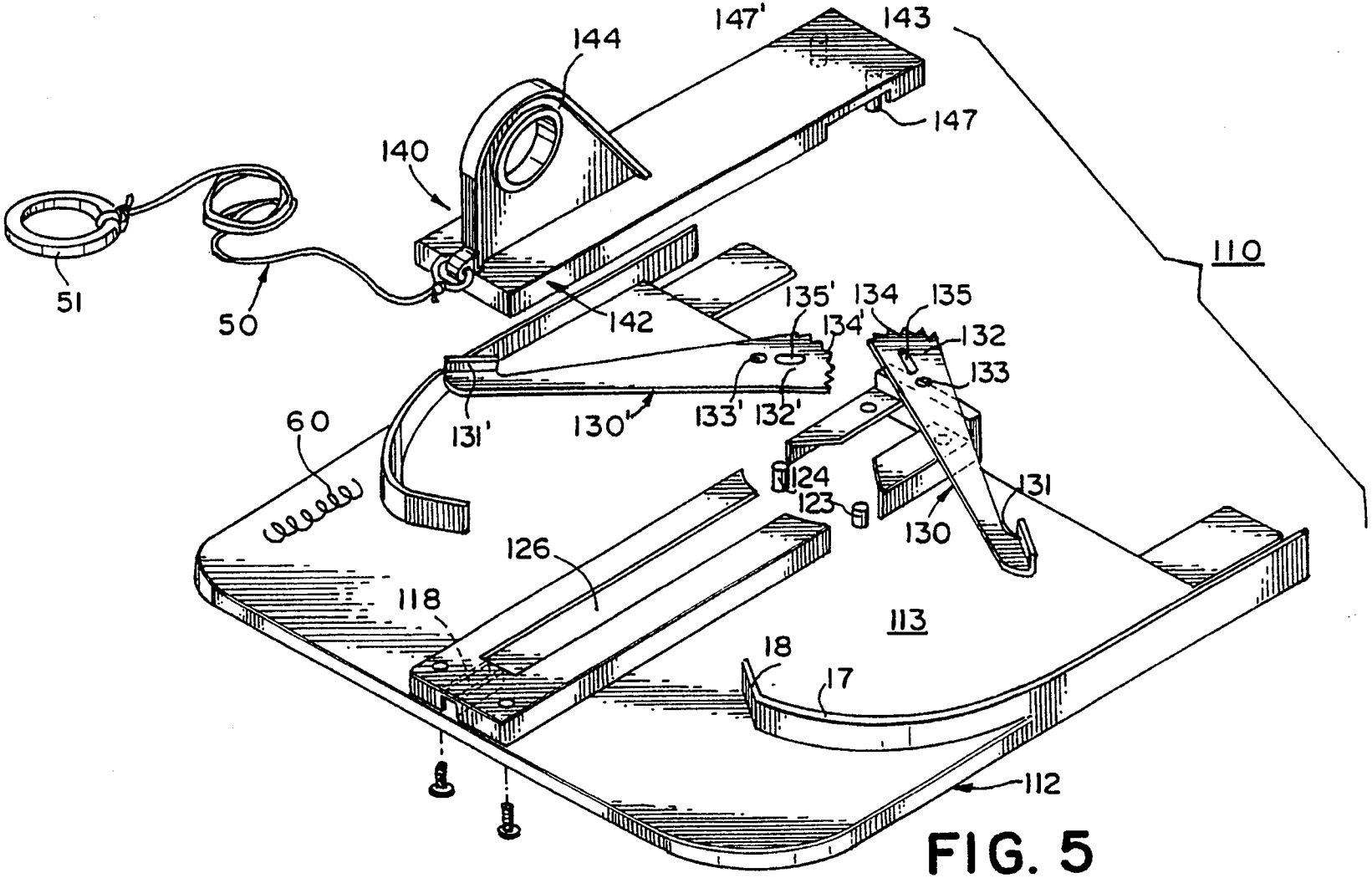
FIG. 5 is an exploded view of a second projectile launching toy device of the present invention.
Figure 6B:
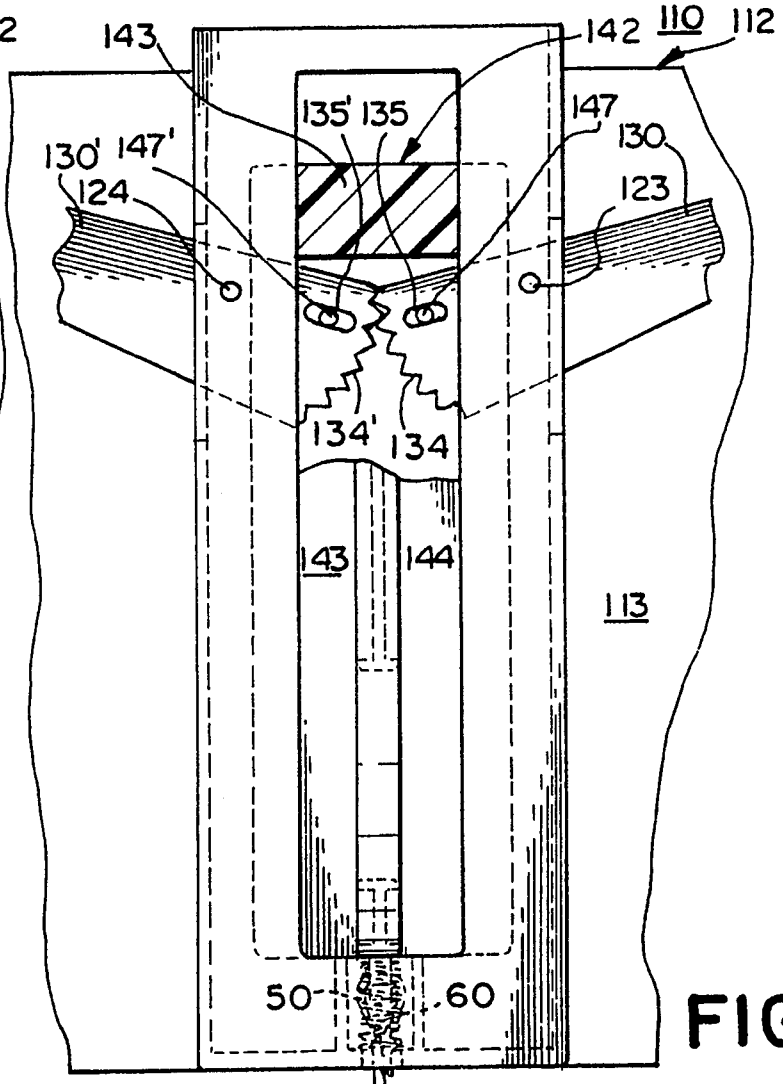
FIGS. 6A and 6B are partial plan section views of the actuator and levers of the device of FIG. 5.
Figure 6A:
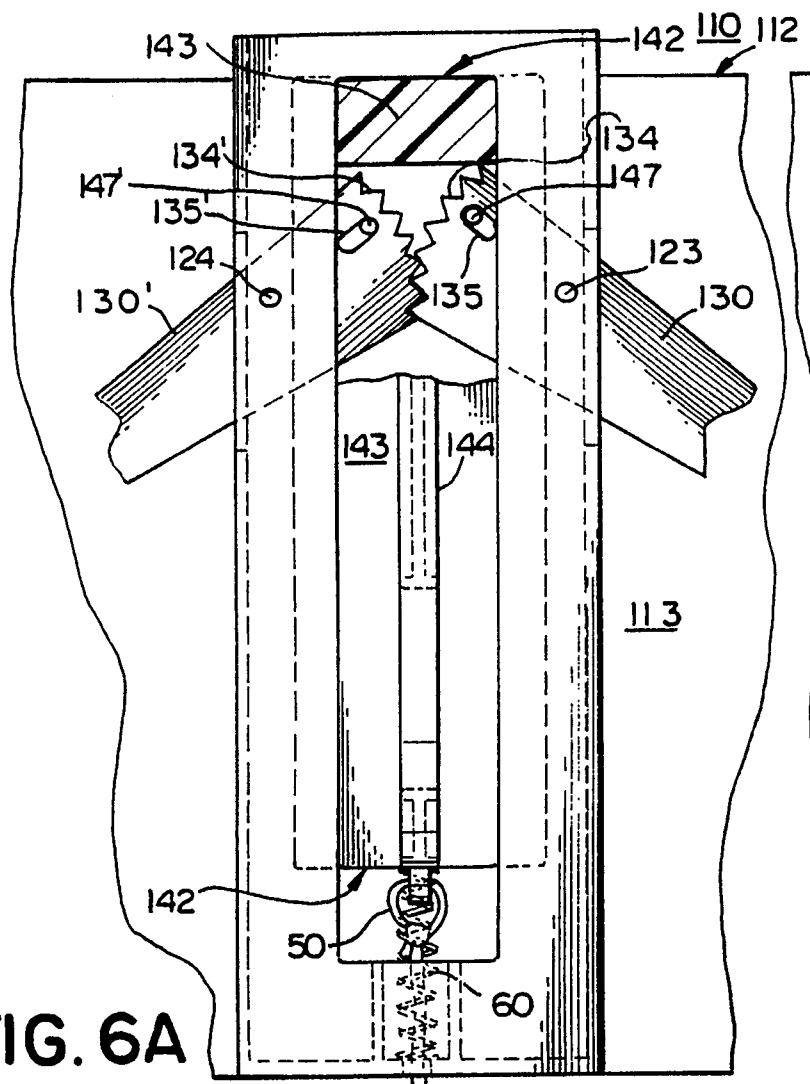

FIGS. 5, 6A and 6B show a second, gear and slot toy projectile launching device embodiment indicated generally at 110, which includes a base 112, actuator 140, right and left levers 130, 130' and return member spring 60. Actuator 140 includes a trigger 142 with slide body 143 and exposed finger grip 144 and/or lanyard 50 with finger ring 51. Lever 130 has gear teeth 134 provided at its second end 132 which intermesh with gear teeth 134' on the second end 132' of the second lever 130'. Lever 130 has a pivot 133 provided between cover 125 and base 112. In this embodiment, pivot 133 preferably is provided by a bore also 133 through lever 130, which now receives a pin 123 projecting upwardly from the upper side 113 of the base 112. Obviously the pin could be provided on the lever 130 and the bore on the base as was the case with the first embodiment of FIGS. 1–4. Lever 130 is optionally but preferably provided with an elongated slot 135, which receives a pin 147 projecting downwardly from the slide body 143 of actuator trigger 142. A second pin 147' is preferably provided on slide body 143 to engage a mirror slot 135' in lever 130'. Pins 147, 147' engage levers 130, 130' through their respective slots 135, 135' to rotate the levers 130, 130' on their pivots 133, 133' as slide body 143 moves rearward and forward in base slot 126. If desired, pins 147, 147' and slots 135, 135' could be eliminated and trigger 142 configured to pivot levers 130, 130' by contacting opposing sides of the levers. Pivoting of the levers 130, 130' from their first or initial position to their second extreme pivoted position is shown in FIGS. 6A and 6B, respectively. A well 118 is provided in base 112 to receive spring 60.

Figure 7:
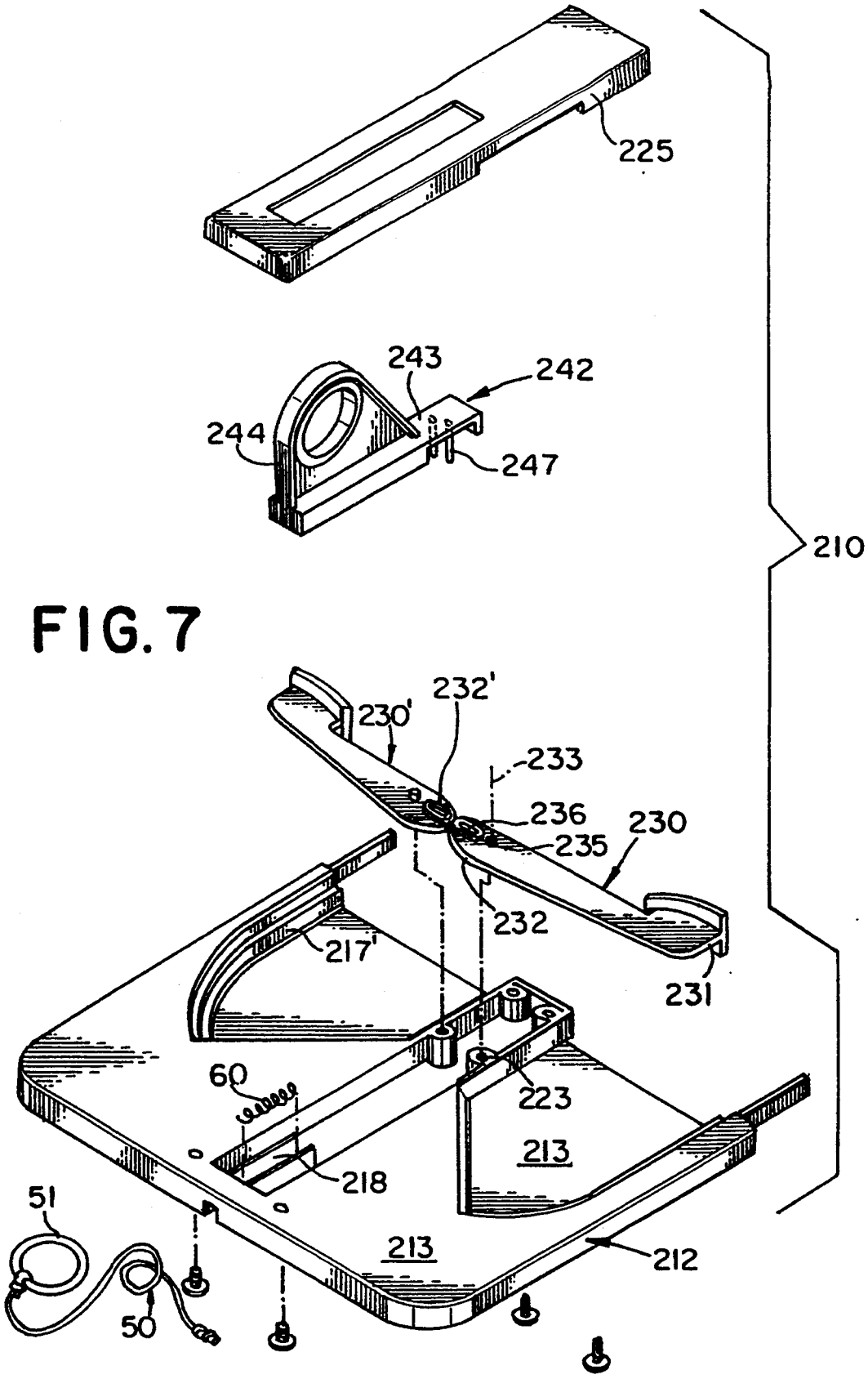
FIG. 7 is an exploded view of a third projectile launching toy device of the present invention.
Figure 8B:
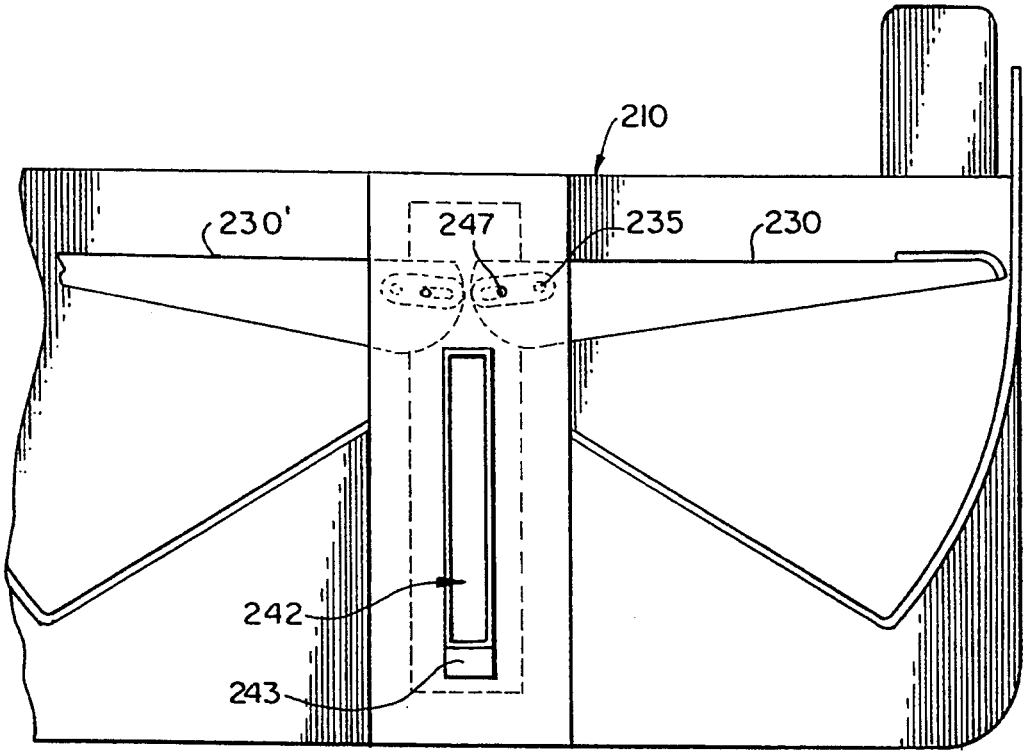
FIGS. 8A and 8B are partial plan section views of the actuator and levers of the device of FIG. 7.
Figure 8A:
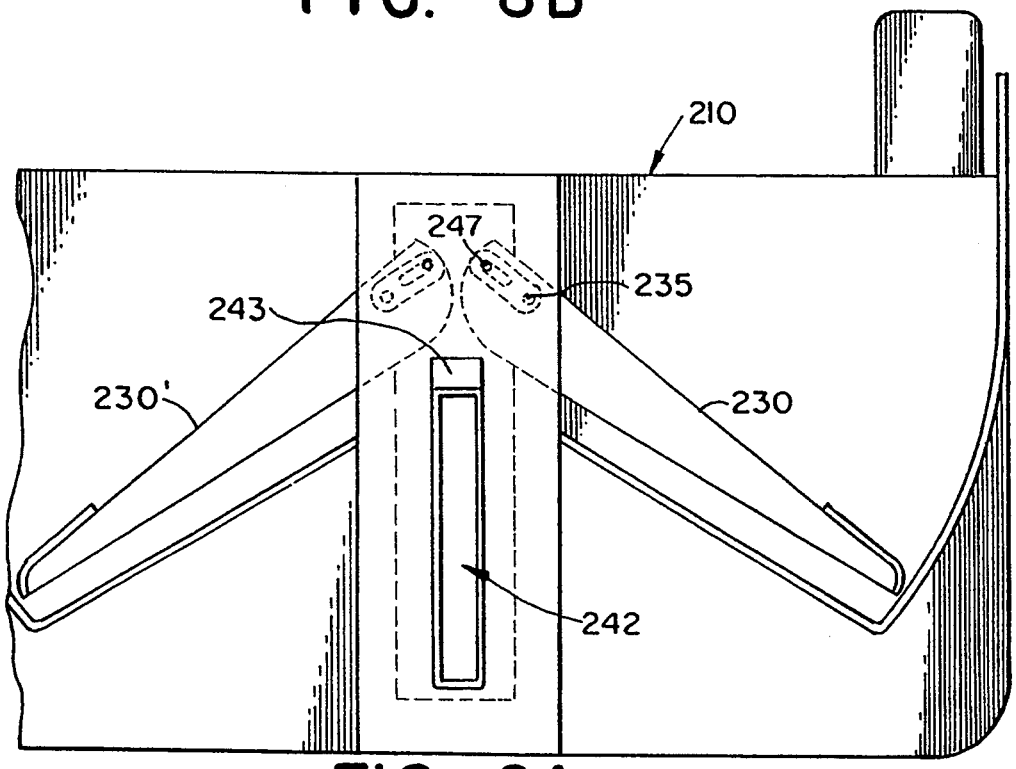

FIGS. 7, 8A and 8B depict a third, slotted slide version of the launcher, indicated generally at 210. Again the launcher 210 comprises a base indicated generally at 212, a pair of mirror levers 230, 230', an actuator 240 provided by a trigger 242 and/or with finger grip 244 and/or, if desired, a lanyard 50 with ring 51, and a return member spring 60. A well 218 is provided in the base 212 to receive and retain the spring return member 60. In addition, the upper surface 213 of the base has been raised so as to partially define a channel receiving the slide block and the areas swept by the levers 230, 230'. Again lanyard 50 with ring 51 may be provided in addition to or in place of finger grip portion 244.

Lever 230 includes a pivot provided by a pair of coaxially opposing pins, one of which is indicated at 235, which are located proximal the second end 232 and which are received in bore 223 provided in the upper side 213 of base 212 and in a bore (not depicted) on the underside of cover 225. Lever 230 further includes a generally elongated slot 236 between pin 235 and the extreme second end of lever 230, which receives a pin 247 projecting downwardly from the slide block portion 243 of the trigger 242. Again, mirror pins and slots are provided for the second lever 230'. Operation of device 210 is the same as the previous devices 11 and 110 with respect to launching a wheeled toy vehicle or other toy projectile, except there is no gear engagement with the second ends 232, 232' of levers 230, 230'. Levers 230, 230' are depicted in the first of the opposing, extreme pivoted positions in FIG. 8A and in the second of the opposing, extreme pivoted positions in FIG. 8B.

Figure 9:
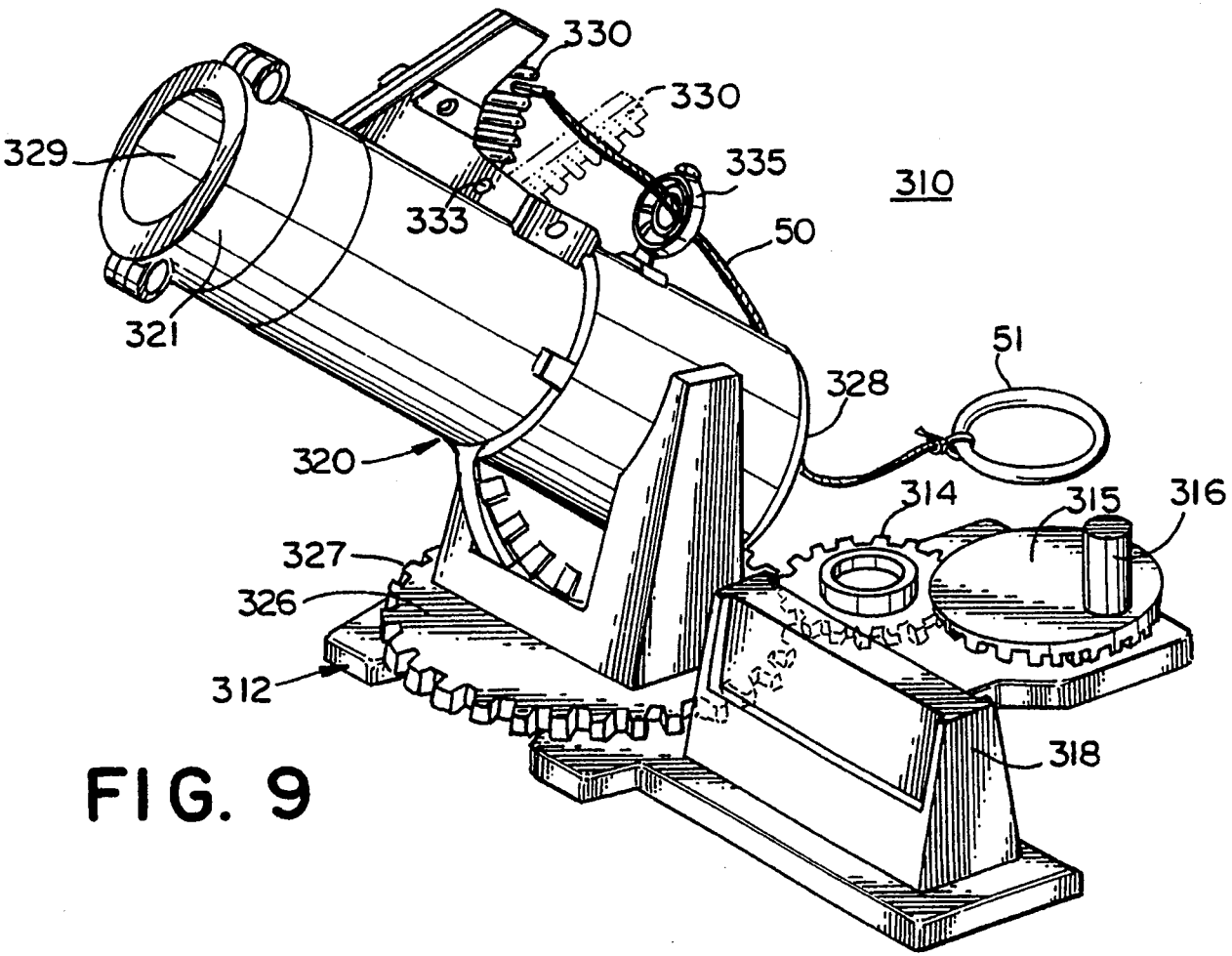
FIG. 9 is a perspective view of a fourth projectile toy launching device of the present invention.
Figure 10:
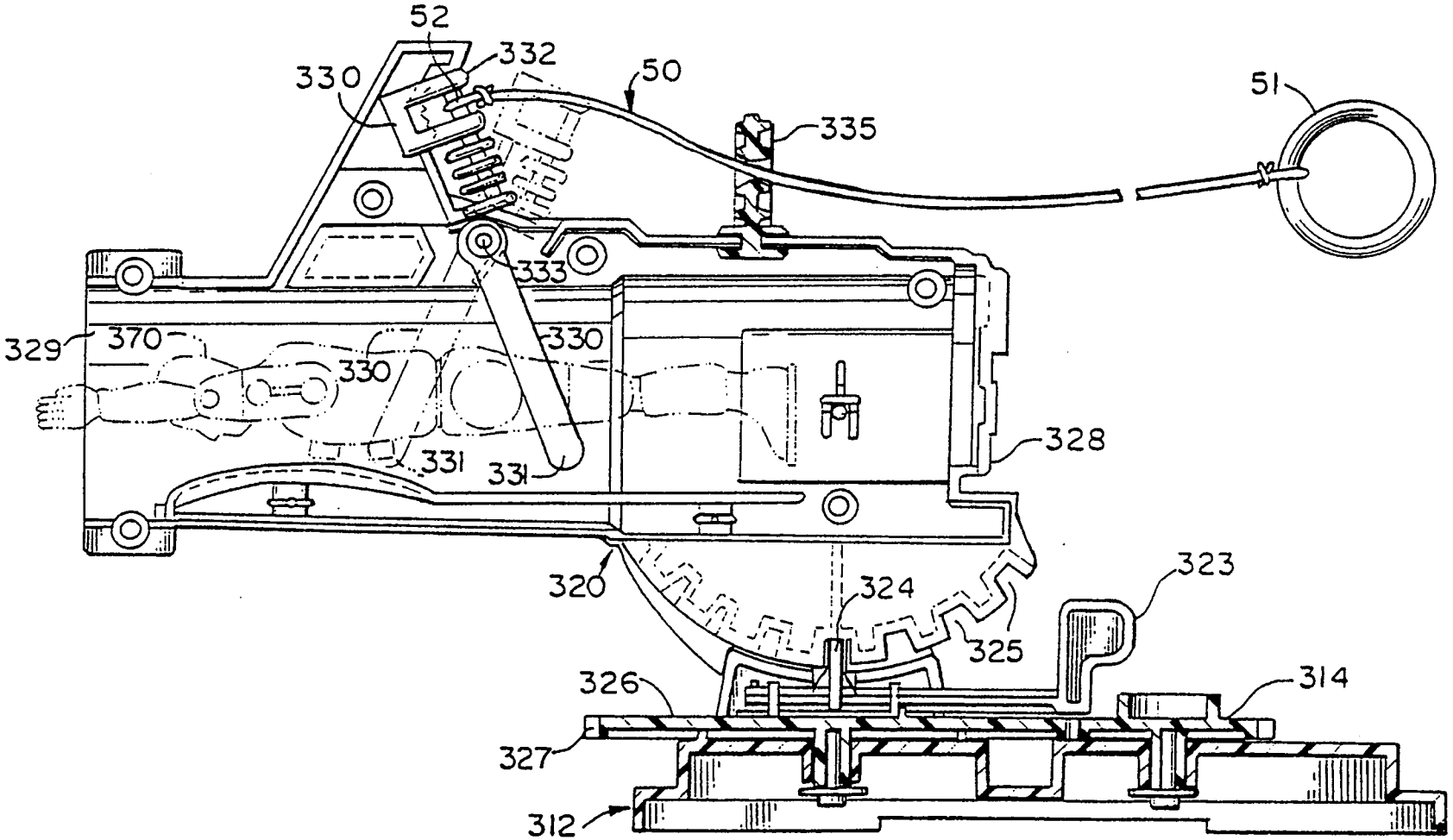
FIG. 10 is a sectioned side elevation view of the device of FIG. 9 taken through the launch tube.

FIGS. 9 and 10 depict a fourth embodiment projectile launching toy device of the present invention, indicated generally at 310, in the form of a toy cannon. Device 310 includes a base indicated generally at 312 and launcher indicated generally at 320 comprising a hollow launch tube 321. Tube 321 is rotatably supported in a fork 322 extending upwardly from a turntable 326 rotatably supported on base 312. A locking key 323 is movably supported on turntable 326 and includes a pin 324, which can be selectively engaged in any of a plurality of slots 325 provided along an arc at the bottom of the hollow tube 321 to selectively vary elevation of the tube 321. Turntable 326 has a plurality of gear teeth 327 extending around its circumference. These teeth engage with the teeth of an idler gear 314, which is rotatably mounted on the base 312. The teeth of gear 314 further mesh with the teeth of gear 315 provided with a hand crank 316, which is also rotatably mounted on the base. Turntable 326, gears 314, 315 and hand crank 316 enable the launcher 320 to be rotated 360 degrees in azimuth. A stationary structure 318 projecting up on one side of the base 312 is provided as a handgrip to assist in manually holding the base 312 stationary during use.

A generally vertically oriented lever 330 is rotatably supported with respect to the top side of the tube 321 on a pivot 333, which may be a pin, bolt, screw or a molded part of the tube 321. A first portion of the lever 330, including a longitudinal first end 331, extends generally diametrically into the tube at least partially and preferably, substantially spanning its hollow interior in a radial direction. A second, remaining portion of lever 330 with second longitudinal end 332 at least partially projects outside of and is exposed on the top side of the tube 321. An actuator, preferably in the form of a lanyard 50 with finger ring 51, is provided. A first end 52 of the lanyard 50 is coupled with and, preferably, secured to the second end 332 of the lever 330. Preferably the lanyard 50 extends through a guide 335 projecting upwardly from the top side of hollow tube 321 between the lever 330 and a closed end 328 of the tube 321. A return member is provided preferably in the form of a torsion coil spring 360, which is mounted encircling the lever pivot 333. One end of the return member spring 360 is wrapped partially around the lever 330 while a second end is compressed against a stop 340 provided in the upper inner side of the tube 321.

The interior of hollow tube 321 defines a surface which is configured to support and guide a toy projectile, for example a toy action FIG. 370, along a ballistic path which begins at the open end 329 of tube 321 through which the action FIG. 370 or other toy projectile exits. The interior of the tube 321 is preferably generally symmetric with respect to a longitudinal vertical plane depicted in FIG. 10 in which the lever 330 also lies and moves.

Operation of the launcher 320 of the device 310 is straightforward. Return member spring 360 biases the lever 330 to its initial position shown in solid in FIGS. 9 and 10. A projectile such as action FIG. 370 is loaded through the open end 329 of the launch tube 321 until a portion of it abuts the first end 331 of the lever 330. When it is desired to launch the projectile, the ring 51 of the lanyard 50 is sharply jerked rearwardly. As the lanyard 50 pivots the lever 330 to the second extreme position of the lever 330, indicated in phantom in FIGS. 9 and 10, the lever 330 launches the action FIG. 370 through the open end 329 of the tube 321. When the lanyard 50 is again released, return member spring 360 rotates lever 330 back to its initial position. Guide 335 insures that the lanyard 50 is brought back straight towards the closed end 328 of the tube 321 when the lanyard 50 is tensioned. Again, by spacing the first end 331 of lever 330 in the hollow interior of tube 321 farther from pivot 333 than is the attachment of the first end 52 of lanyard 50 with the first end 331 of the lever 330, a magnification of the linear movement of the first end 331 of lever 330 in tube 321 can be achieved. Elevation of the tube 321 is controlled by setting pin 324 of locking key 323 in the appropriate slot 325 while azimuth is controlled and selected by adjustment of turntable 326 through gears 314, 315 and hand crank 316.

While several preferred embodiments of the present invention have been disclosed and several modifications thereto suggested, it will be recognized of ordinary skill in the art that various known arrangements and elements can be substituted equivalently for those described without departing from the broad inventive concept thereof. It should be understood, therefore, that the invention is not limited to the particular embodiments disclosed, but is intended to cover all embodiments within the scope and spirit of the invention as defined by the appended claims.

I/we claim:

1. A toy projectile launching device comprising:

a surface configured with both a horizontal aspect and a vertical aspect to support and guide a toy projectile along a path from an initial position of the projectile on the surface to an exit from the surface;

a lever having opposing longitudinal first and second ends and a pivot between the first and second ends, the lever being supported at the pivot such that the first end of the lever traverses the surface along the path in a direction from the initial position towards the exit from the surface when the lever is rotated on the pivot between opposing, extreme first and second positions;

an actuator coupled with the second end of the lever, at least a portion of the actuator being configured and exposed sufficiently to be manually grasped and moved to rotate the lever from the first position to the second position;

a return member positioned so as to automatically return the lever from the second position to the first position after manual movement of the lever by the actuator;

wherein the second end of the lever is located closer to the pivot than is the first end of the lever;

wherein the return member is resiliently flexible; and wherein the actuator comprises a lanyard coupled with the second end of the lever, the lanyard being mounted in the device to move the lever only in a direction from the first pivot position to the second pivot position when tensioned.

2. The device of claim 1 wherein the lever is supported at the pivot for movement in a generally horizontal plane over a generally horizontally oriented portion of the surface.

3. The device of claim 2 wherein at least a portion of the path and the surface at the initial position is at least generally radiused with respect to the pivot.

4. The device of claim 3 wherein the lever further includes a plurality of teeth at the extreme second end of the lever.

5. The mechanism of claim 4 further comprising a base defining at least a portion of the surface and wherein the actuator comprises a trigger movably coupled with the base and coupled with the second end of the lever, a portion of the trigger being configured and exposed to permit the trigger to be manually grasped and to be moved to rotate the lever from the first position to the second position.

6. The mechanism of claim 5 wherein the trigger is mounted to slide across the base.

7. The device of claim 6 further comprising a second lever symmetrically supported with respect to the lever and the actuator.

8. The mechanism of claim 5 wherein the trigger is mounted to slide across the base.

9. The device of claim 8 further comprising a second lever symmetrically supported with respect to the lever and the actuator.

* * * * *